US006183355B1

(12) United States Patent
Robinson

(10) Patent No.: US 6,183,355 B1
(45) Date of Patent: Feb. 6, 2001

(54) ADAPTER APPARATUS FOR SANDING, GRINDING OR BUFFING

(76) Inventor: Walter J. Robinson, 141 Sanders Ave., Lowell, MA (US) 01851

( * ) Notice: Under 35 U.S.C. 154(b), the term of this patent shall be extended for 0 days.

(21) Appl. No.: 09/160,847

(22) Filed: Sep. 25, 1998

(51) Int. Cl.[7] ..... B24B 19/00

(52) U.S. Cl. ..... 451/415; 451/418; 451/438; 451/490; 451/518

(58) Field of Search ..... 451/415, 418, 451/438, 441, 490, 518, 519

(56) References Cited

U.S. PATENT DOCUMENTS

| | | | | |
|---|---|---|---|---|
| 487,198 | | 11/1892 | McCutchan . | |
| 1,643,882 | | 9/1927 | Faiver . | |
| 1,653,108 | | 12/1927 | Koenig . | |
| 1,681,648 | | 8/1928 | Root . | |
| 2,755,606 | * | 7/1956 | Ronvold et al. . | |
| 2,854,829 | | 10/1958 | Porter . | |
| 2,922,261 | | 1/1960 | Rabkin et al. . | |
| 2,977,807 | * | 4/1961 | Conover . | |
| 3,229,428 | * | 1/1966 | Sargolini . | |
| 3,364,625 | | 1/1968 | Sogge . | |
| 3,874,125 | | 4/1975 | Stroezel | 51/170 TL |
| 3,900,974 | | 8/1975 | Klebe, Jr. et al. | 51/170 MT |
| 3,928,947 | | 12/1975 | Millett | 51/170 T |
| 3,943,669 | | 3/1976 | Strozel | 51/170 MT |
| 4,302,910 | | 12/1981 | Tschacher | 51/170 MT |
| 5,403,231 | * | 4/1995 | Duckworth . | |

* cited by examiner

*Primary Examiner*—Timothy V. Eley
*Assistant Examiner*—Willie Berry, Jr.
(74) *Attorney, Agent, or Firm*—Pearson & Pearson, LLP

(57) ABSTRACT

An adapter apparatus for use with a power operated surface preparation device comprising an upper cap positioned on a first end of a stainless steel spring and a lower cap positioned on a second end of the spring. The center of the upper cap has a threaded opening and the center of the lower cap has a threaded opening wherein a shaft of the power tool is fastened to the upper cap and a shaft of a disk is fastened to the center of the lower cap. The power device rotates at speeds up to 10,000 RPMs and the disk on the lower end adapter of the apparatus maintains close contact with a work surface while an operator exerts minimum force only to guide the power device from area to area and not to maintain the disk touching the work surface.

20 Claims, 4 Drawing Sheets

ADAPTER APPARATUS FOR SANDING, GRINDING OR BUFFING

BACKGROUND OF THE INVENTION

1. Field of the Invention

The present invention relates generally to a portable power operated surface preparation device and more particularly to an adapter having a surface treating disk attached to one end and a power unit attached to the other end.

2. Description of Related Art

Power tools for sanding, grinding or buffing are well-known in the art. When a sanding pad is attached to a disk of power sander or grinder, there is a tendency for the tool to walk away from the operator requiring extra effort by the operator to keep the tool touching a particular area until the operator decides to move the tool to another area. This results in the operator tiring quicker compared to an operator only providing force to guide the power tool from one area to another.

In U.S. Pat. 1,653,108 issued Dec. 20, 1927 to Otto A. Koenig a power operated surface machine is described which is hand manipulated and by which the surfacing is accomplished with a rotary motion or a rotary motion plus a reciprocatory motion hand applied. The machine comprises a housing which is cup-shaped opened at the lower end. A shaft runs through the center of the cup and has a hollow lower end for housing a central cushion spring. A flange abutment plate is secured under the shaft section and a larger cushion spring encircling the shaft. The central spring serves to exert downward pressure at the center of a flexible disk attached to the bottom of the shaft and the cushion spring exerts pressure on the peripheral portions of the flexible disk. These two springs provide surface conforming contact of the disk with the surface being worked on. However, the disk is rotated at only 1800 RPM.

In U.S. Pat. 1,643,882 issued Sep. 27, 1927 to M. A. Faireo, a meat block cleaver is described comprising an electric motor in a housing with a lower member and cleaning brush attached to the housing by compression springs which encircle 4 bolts equally spaced and extend through a circular plate. An operator moves the device across the surface of the meat block to be scraped and cleaned. Typically two hands are required by the operator to control this power tool.

In U.S. Pat. 1,681,648 issued Aug. 21, 1928 to Chandler S. Root a rubbing machine is described for polishing automobile bodies and woodwork of various kinds. The machine comprises upper and under casings and a plurality of helical springs disposed between the casing.

SUMMARY OF THE INVENTION

Accordingly, it is therefore an object of this invention to provide an adapter for attachment to one of a plurality of power units for performing sanding, grinding or buffing.

It is another object of this invention to provide a disk on one end of an adapter for attaching a means for sanding, grinding or buffing, the adapter being attached to a power unit and hand operated with minimum force required only to guide the power unit from one area to another area and not to exert force to keep the disk touching the work area.

It is another object of this invention to provide an adapter for use on a motorized carriage apparatus for sanding, grinding or buffing floors.

These and other objects are accomplished by providing an adapter for operation with a power unit comprising a first cap including means for fastening the first cap to the power unit, a second cap including means for fastening the second cap to a disk, spring means having a first end attached to the first cap and a second end attached to the second cap for transferring rotary motion from the power unit to the disk. The first cap comprises a threaded wing nut for receiving a threaded shaft of the power unit. The second cap comprises a threaded wing nut for receiving a threaded shaft of the disk. The spring means a single spring or may comprise a plurality of springs. The first cap and the second cap comprise plastic material. The power unit comprises an electric motor or the adapter may be driven by pneumatic means for rotating the disk. The disk includes means for sanding, grinding or buffing a surface.

The objects are further accomplished by a method of providing an adapter for operation with a power unit comprising the steps of providing a first cap including means for fastening the first cap to the power unit, providing a second cap including means for fastening the second cap to a disk, attaching a first end of a spring means to the first cap and a second end of the spring means to a second cap for transferring rotary motion from the power unit to the disk. The step of fastening a second cap of the adapter to a disk comprises the step of providing, on a lower surface of the disk, means for sanding a surface area. The step of fastening a second cap of the adapter to a disk comprises the step of providing, on a lower surface of the disk, means for grinding a surface area. The step of fastening a second cap of the adapter to a disk comprises the step of providing on a lower surface of the disk, means for buffing a surface area.

The objects are further accomplished by the combination of means for producing rotary motion, an adapter for connecting the rotary motion producing means to an applicator, the adapter comprises a first cap including means for fastening the first cap to the rotary motion producing means, a second cap including means for fastening the second cap to the applicator, and spring means having a first end attached to the first cap and a second end attached to the second cap for transferring rotary motion from the rotary motion producing means to the applicator. The rotary motion producing means comprises an electric motor or a pneumatic means. The spring means comprises a single spring, or an alternate embodiment the spring means comprises a plurality of springs attached between the first cap and the second cap approximately equal distance from each other.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
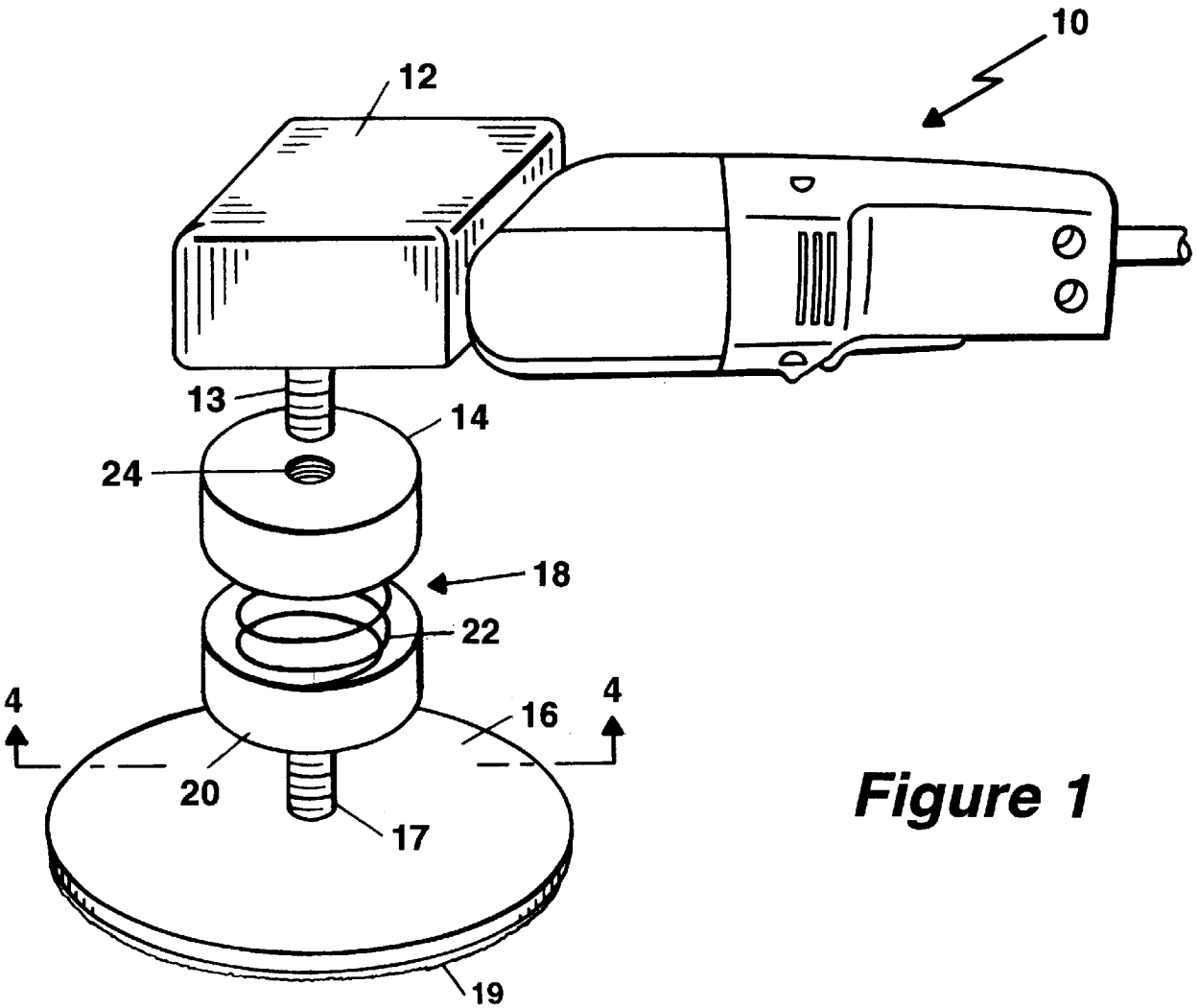
FIG. 1 is an exploded perspective view of a power tool embodying the invention for surface preparation.

Referring to FIG. 1 a perspective view of a portable power unit 10 is shown comprising the invention of an adapter 18. A first end attaches to a threaded shaft 13 extending from and driven by an electric motor 12. A disk 16 having a threaded stud 17 attaches to the second end of the adapter 18. Attached to the underside of disk 16 is sandpaper or other material 19 depending on a user's application. For example, in polishing applications a soft cloth material is provided on the disk 16. Although the adapter 18 is shown in FIG. 1 attached to the motor 12 of the portable power unit 10, the adapter 18 may be attached to a motor on a floor sander carriage (not shown) and obtain improved performance as with the portable hand power unit 10. An operator only has to provide force to guide the portable power unit 10 from one area to another, and not provide force, as needed with prior art portable power units, to keep the tool end touching a particular work area when using with the adapter 18. The adapter 18 may be operated by the electric motor 12 at speeds up to 10,000 RPMs.

Figure 2:
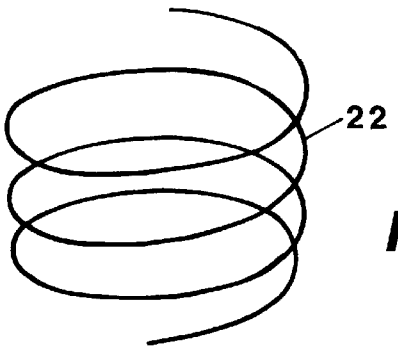
FIG. 2 is a side elevational view of the spring of FIG. 1.

Referring to FIG. 1. and FIG. 2., FIG. 2 shows a side elevational view of the spring 22 of FIG. 1 prior to insertion in caps 14 and 20. The adapter 18 comprises an upper cap 14, a lower cap 20 and a spring 22. One end of spring 22 is secured within the upper cap 14 and the other end of spring 22 is secured within the lower cap 20. The upper cap 14 and lower cap 20 are made by injection molding of plastic which is well known to those skilled in the art, and the spring 22 is made of ⅛ inch stainless steel. Other size springs may be used depending on the application requirement. The caps 14 and 20 with an end of the spring 22 secured in each cap may be fabricated by less automated techniques well known to those skilled in the art. The distance between upper cap 14 and lower cap 20 is typically approximately ⅜ inches. This spacing allows for approximately a twenty degree tilt angle by upper cap 18 relative to lower cap 20 while the lower cap 20 remains flush on the surface being worked on.

Figure 3:
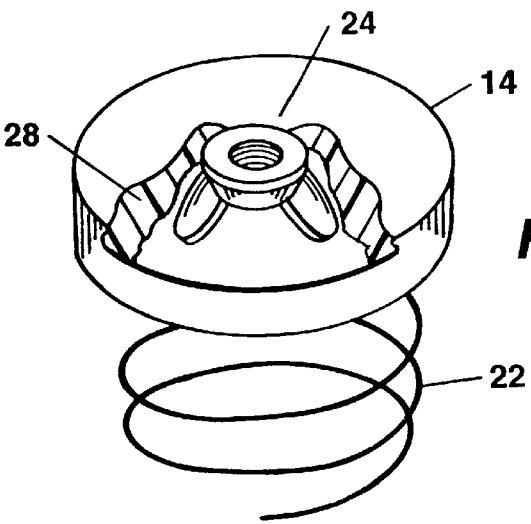
FIG. 3 is a cut away perspective of an upper cap of the invention showing a threaded wing nut in the center of the top of the upper cap.
Figure 4:
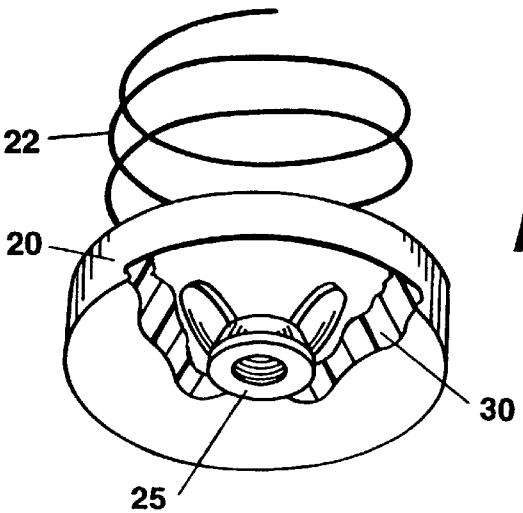
FIG. 4 is cut-away perspective of a lower cap of the invention showing a threaded wing nut positioned in the center of the bottom of the cap.

Referring now to FIG. 3. and FIG. 4, FIG. 3 is a cut away perspective view of the upper cap 14 showing a 5⁄16 inch threaded wing nut 24 embedded in the upper surface of cap 14. FIG. 4 is a cut away perspective view of the lower cap 14 showing a 5⁄16 inch threaded wing nut 25 embedded in the lower surface of cap 20. Other size nuts may be equally applicable depending on the size of the motor shaft 13 and disk stud 17. The upper cap 14 receives the threaded shaft 13 from the motor 12 and the lower cap 20 receives the threaded shaft 17 from the disk 16. The size of the threaded nuts 24, 25 may vary depending on the particular brand of motor 12 or disk 16 used with the adapter 18. The upper cap 14 and the lower cap 20 are filled with an epoxy material 28, 30 which may be embodied by epoxy or body filter made by Dynatron Bondo Company of Atlanta, Georgia. The epoxy holds the wing nuts in the center of the outer surface of each cup 14, 20.

Figure 5A:
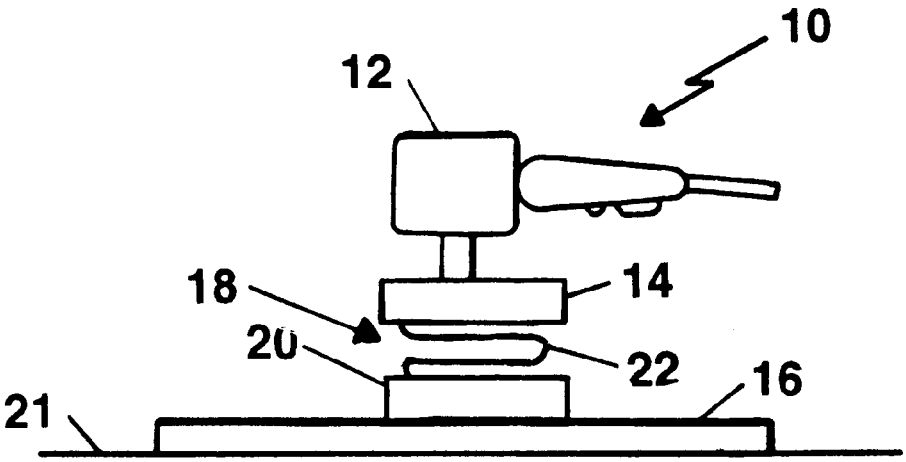
FIG. 5A is a side elevational view of the power unit with an adapter attached showing the position of the upper cap and the lower cap of the adapter when the power unit shaft is perpendicular to the disk.
Figure 5B:
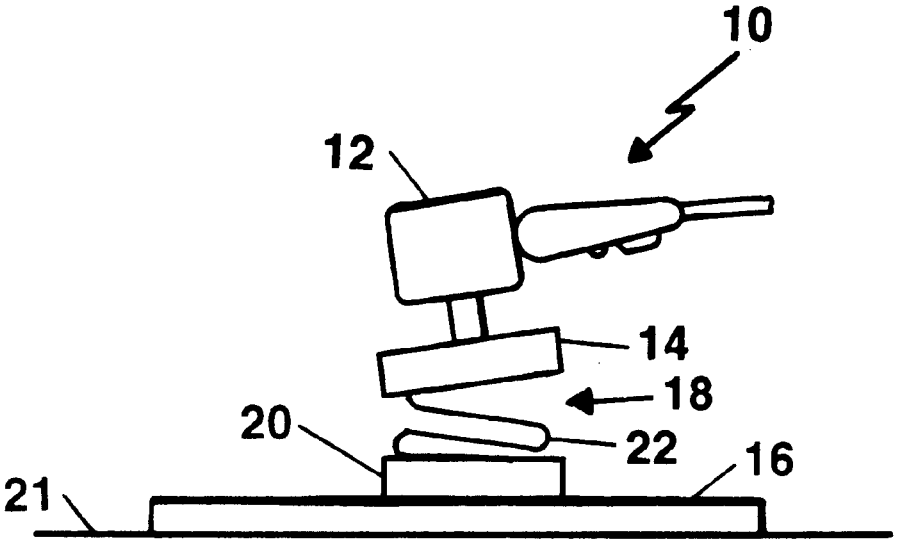
FIG. 5B is a side elevational view of the power unit with an adapter attached showing the power unit and upper cap in a position tilted with respect to the lower cap disposed adjacent to the disk.

Referring now to FIG. 5A and FIG. 5B, FIG. 5A is a side elevational view of the power unit 10 with the adapter 18 attached showing the upper cap 14 and the lower cap 20 parallel to each other when the power unit shaft 13 is perpendicular to the disk 16. FIG. 5B is a side elevational view of the power unit 10 with the adapter 18 attached showing the position of the power unit upper cap 14 tilted with respect to the lower cap 20 and the disk 16 which are flush and parallel to the surface 21 during operation. This is a significant feature of the invention. When the disk 16 is placed in contact with a surface being operated on, whether sanding, grinding or buffing, the disk tends to remain stationary until an operator moves the power unit to another area. The power unit is not pulled away by centrifugal force as has been so common with the prior art. This feature is particularly useful when working on curved objects.

Figure 7:
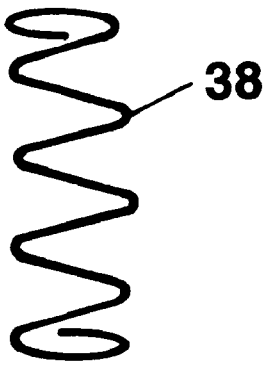
FIG. 7 is a side elevational view of the spring of FIG. 6.
Figure 6:
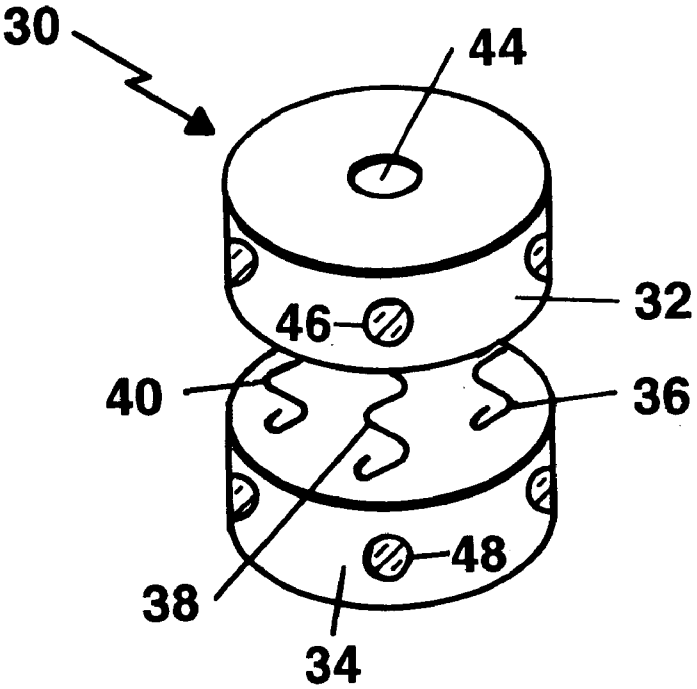
FIG. 6 is a perspective view of an alternate embodiment of the invention comprising a plurality of smaller springs.

Referring now to FIG. 6 and FIG. 7, FIG. 6 shows a perspective view of an alternate embodiment of the invention comprising an adapter 30. The adapter 30 includes upper cap 32 and lower cap 34 interconnected by four equally spaced springs 36, 38, 40, 42. FIG. 6. shows one of the springs 38 prior to being embedded in caps 32, 34 which may be embodied by a commonly available spring with Part No. 181 obtainable at Sears Hardware Stores. The adapter 30 may be operated with a motor 12 at speeds up to 3,600 RPMs.

Referring again to FIG. 1, the motor 12 may be embodied by a motorized hand tool such as Model No. 900.277230, manufactured by Sears, Roebuck and Co. of Hoffman Estates, Ill. The spring 22 may be embodied by Part No. 407 manufactured by Spring Mfg. Co. of Tewksbury, Massachusetts.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. An adapter for operation with a power unit comprising:

a first cap including means for fastening said first cap to said power unit, a second cap positioned a predetermined distance from said first cap and including means for fastening said second cap to a disk, spring means having a first end attached inside said first cap and a second end attached inside said second cap for transferring rotary motion from said power unit to said second cap, said spring means having a length for positioning said second cap said predetermined distance from said first cap.

2. The adapter as recited in claim 1 wherein:

said first cap comprises a threaded nut for receiving a threaded shaft of said power unit.

3. The adapter as recited in claim 1 wherein, said second cap comprises a threaded nut for receiving a threaded s haft of said disk.

4. The adapter as recited in claim 1 wherein said spring means comprises a single spring.

5. The adapter as recited in claim 1 wherein said spring means comprises a plurality of springs.

6. The adapter as recited in claim 1 wherein said first cap and said second cap comprise plastic material.

7. The adapter as recited in claim 1 wherein said power unit comprises an electric motor.

8. The adapter as recited in claim 1 wherein said power unit comprises pneumatic means for rotating said adapter.

9. The adapter as recited in claim 1 wherein said disk includes means for sanding a surface.

10. The adapter as recited in claim 1 wherein said disk includes means for grinding a surface.

11. The adapter as recited in claim 1 wherein said disk includes means for buffing a surface.

12. A method of providing an adapter for operation with a power unit comprising the steps of:

providing a first cap including means for fastening said first cap to said power unit, providing a second cap positioned a predetermined distance from said first cap and including means for fastening said second cap to a disk, attaching a first end of a spring means inside said first cap and a second end of said spring means inside said second cap for transferring rotary motion from said power unit to said second cap, said spring means having a length for positioning said second cap said predetermined distance from said first cap.

13. The method as recited in claim 12 wherein said step of providing a second cap including means for fastening said second cap of said adapter to a disk comprises the step of providing, on a lower surface of said disk, means for sanding a surface area.

14. The method as recited in claim 12 wherein said step of providing a second cap including means for fastening said second cap of said adapter to a disk comprises the step of providing, on a lower surface of said disk, means for grinding a surface area.

15. The method as recited in claim 12 wherein said step of providing a second cap including means for fastening said second cap of said adapter to a disk comprises the step of providing, on a lower surface of said disk, means for buffing a surface area.

16. In combination:

means for producing rotary motion;

an adapter for connecting said rotary motion producing means to an applicator;

said adapter comprises a first cap including means for fastening said first cap to said rotary motion producing means, a second cap positioned a predetermined distance from said first cap and including means for fastening said second cap to said applicator, and spring means having a first end attached inside said first cap and a second end attached inside said second cap for transferring said rotary motion from said rotary motion producing means to said applicator, said spring means having a length for positioning said second cap said predetermined distance from said first cap.

17. The combination as recited in claim 16 wherein said rotary motion producing means comprises an electric motor.

18. The combination as recited in claim 16 wherein said is rotary motion producing means comprises a pneumatic means.

19. The combination as recited in claim 16 wherein said spring means comprises a single spring.

20. The combination as recited in claim 16 wherein said spring means comprises a plurality of springs attached between said first cap and said second cap approximately equal distance from each other.

* * * * *